United States Patent [19]

Hasenclever

[11] Patent Number: 5,019,188

[45] Date of Patent: May 28, 1991

[54] PROCESS FOR FORMING AN ALUMINUM ALLOY THIN SHEET BY HOT AND COLD ROLLING

[75] Inventor: Jochen Hasenclever, Bonn, Fed. Rep. of Germany

[73] Assignee: Vereingte Aluminum-Werke Aktiengesellschaft, Fed. Rep. of Germany

[21] Appl. No.: 511,105

[22] Filed: Apr. 20, 1990

[30] Foreign Application Priority Data

Apr. 22, 1989 [DE] Fed. Rep. of Germany ..... 3913324

[51] Int. Cl.[5] ..... C22F 1/04; C22C 21/00

[52] U.S. Cl. ..... 148/11.5 A; 420/535

[58] Field of Search ..... 148/11.5 A; 420/535

[56] References Cited

U.S. PATENT DOCUMENTS

| | | | |
|---|---|---|---|
| 4,282,044 | 8/1981 | Robertson et al. | 148/11.5 A |
| 4,431,463 | 2/1984 | Althoff | 148/11.5 A |
| 4,517,034 | 5/1985 | Merchant et al. | 148/11.5 A |
| 4,605,448 | 8/1986 | Baba et al. | 148/11.5 A |
| 4,753,685 | 6/1988 | Usui et al. | 148/12.7 A |
| 4,855,107 | 8/1989 | Teirlinck et al. | 148/11.5 A |

*Primary Examiner*—Upendra Roy

*Attorney, Agent, or Firm*—Perman & Green

[57] ABSTRACT

Novel aluminum alloy composition and process for producing aluminum rolled semifinished strip material having a grain structure with grain diameters less than about 15 μm, and having less than about 5 vol. % of rod shaped intermetallic phases. The present process comprises the steps of homogenizing rolling ingots of the present alloys, hot-rolling and then cold-rolling the ingots without intermediate annealing, and finally annealing the cold-rolled bars having a thickness between about 40 and 250 μm.

4 Claims, No Drawings

PROCESS FOR FORMING AN ALUMINUM ALLOY THIN SHEET BY HOT AND COLD ROLLING

BACKGROUND OF THE INVENTION

1. Field of the Invention

The invention relates to an aluminum rolled semifinished product in the form of sheets, strips, or foils, composed of an aluminum alloy of the AlFeMn type with a uniform, fine-grained structure, and a process for its manufacture.

2. Description of Prior Art

It is known from Altenpohl "Looking at Aluminum from the Inside," 2nd edition, 1970, page 102, that when making semifinished products which must fulfill strict requirements as to workability, full annealing at temperatures between 550° and 630° C. must be performed. Annealing time depends on the grain size and the diffusion rate of the critical alloy component. If, at the maximum possible full annealing temperature according to the phase diagram, one alloy component is no longer completely soluble in aluminum, a finely distributed precipitation takes place in the interior and at the grain boundaries of the cast grains. The influence of cooling following full annealing is shown, on page 101 of the references, for an alloy with 1% Mn, 0.67% Fe, and 0.16% Si with the remainder being Al in three structural patterns.

The same publication, last page, provides an overview of processes in the structure during the most important stages in the manufacture of rolled semifinished products. After cold working, soft annealing is performed at temperatures of approximately 250° to 500° C. to improve workability.

Deformation hardening is eliminated by recrystallization and numerous fine deposits of alloy metals appear in the microstrcuture, which are precipitated during soft annealing.

In aluminum rolled products containing the known alloy, after conventional manufacturing methods are employed with final annealing, grains on the order of 15–100 μm are produced; the average diameter of all the existing grains is given as the grain size.

In addition, the softening process is such that material states with high strength values and simultaneous high elongation values can be achieved only by using special measures such as high cooling rate, for example. Usually elongation is not sufficient when the strength is sufficiently high to manufacture deep-drawable material, as for example, flat strip material, or the strength is too low while elongation is sufficient.

SUMMARY OF THE INVENTION

The goal of the present invention is to provide an aluminum rolled semifinished product of the aforementioned type, and a process for the manufacture of such product having a grain structure with grain sizes <15 μm, as well as rounded intermetallic phases distributed in a finely dispersed manner. According to the invention this goal is achieved by the features listed in the claims.

It has been found that an especially fine-grain structure is produced according to the novel process of the present invention, which is suitable for many applications, especially for making coils for offset printing plates, fin stock, and also packing foil.

The invention will now be described in greater detail with reference to two embodiments.

DETAILED DESCRIPTION

An aluminum alloy containing 1% Fe, 1% Mn, 0.12% Si, and other elements totalling <0.02% is cast to form an ingot measuring 100×300×500 mm. This is followed by a two-stage homogenization at 610° C. for 6 hours and 480° C. for 5 hours. The ingot is hot-rolled to 4 mm and then cold-rolled to 0.1 mm without intermediate annealing. Final annealing is performed at 350° C. for 2 hours. Evaluation of the grain structure with an optical microscope revealed a grain size between 7 and 10 μm.

Another case ingot with the same dimensions was made from the alloy as above with an additional content of 0.5 wt. % Mg. The ingot was homogenized at 550° C. for 7 hours. Hot-rolling and cold-rolling were performed as described above, followed by final annealing at 350° C. for 2 hours. The grain size of the resultant thin strip was between 8 and 11 μm in diameter.

In general, the novel process for manufacturing rolled semifinished product according to the present invention is characterized by the steps of homogenizing the cast ingots at temperatures between about 620° to 480° C. for about 2 to 20 hours, followed by hot-rolling the homogenized ingots to a hot strip final thickness between about 2.5 to 5 mm followed by cold-rolling of the strip, without intermediate annealing thereof, to a final thickness between about 40–250 μm, followed by final annealing in the temperature range between about 250° to 400° C. for from about 1 to 6 hours.

The formed structures have a grain diameter between about 5 and 15 μm, and the percentage of rod-shaped intermetallic phases therein is less than about 5 vol. %.

The aluminum alloys suitable for use according to the present invention have the following composition:

| Ingredients | Weight percent |
|---|---|
| Fe | 0.7–1.15 |
| Mn | 0.5–2.0 |
| Si | 0.05–0.6 |
| Mg | 0–0.6 |
| Cu | 0–0.3 |
| Zr | 0–0.2 |
| Impurities | –0.03 |
| Aluminum | balance |

The preferred lower limit on the amount of Mg, Cu and/or Zr, if present, is 0.1 wt %, 0.1 wt % and 0.01 wt %, respectively.

It is to be understood that the above described embodiments of the invention are illustrative only and that modifications throughout may occur to those skilled in the art. Accordingly, this invention is not to be regarded as limited to the embodiments disclosed herein but is to be limited as defined by the appended claims.

What is claimed is:

1. Process for manufacturing an aluminum rolled semifinished product comprising the steps of casting a rolling ingot of the following alloy composition:

Fe: 0.7–1.15 wt. %
Mn: 0.5–2.0 wt. %
Si: 0.05–0.6 wt. %
Mg: 0–0.6 wt. %
Cu: 0–0.3 wt. %
Zr: 0–0.2 wt. %
Impurities: 0–0.03 wt. %

Al: balance homogenizing said ingot at a temperature between about 620° to 480° C. for about 2 to 20 hours, hot-rolling said homogenized ingot to a hot strip final thickness between about 2.5 to 5 mm, cold-rolling said hot-rolled strip, without intermediate annealing, to a final thickness between about 40–250 μm, and final annealing said cold-rolled strip at a temperature within the range of from about 250° to 400° C. for about 1 to 6 hours to produce a structure having a grain diameter within the range of about 5 to 15 μm and containing less than about 5 vol % of rod-shaped intermetallic phases.

2. Process according to claim 1 characterized in that said alloy contains at least one alloy element selected from the group consisting of:

Mg: 0.1–0.6 wt. %

Cu: 0.1–0.3 wt. %

Zr: 0.01–0.20 wt. %

3. Process according to claim 1 in which the grain diameter of the final structure is within the range of about 7 to 10 μm.

4. Process according to claim 2 in which said alloy contains magnesium, and the grain diameter of the final structure is within the range of about 8 to 11 μm.

* * * * *